US005343638A

United States Patent [19]

Legassie et al.

[11] Patent Number: 5,343,638

[45] Date of Patent: Sep. 6, 1994

[54] UPPER FOR AN ATHLETIC SHOE AND METHOD FOR MANUFACTURING THE SAME

[75] Inventors: Charles P. Legassie, Canton; Paul E. Litchfield, S. Cerafton; David Lacorazza, Canton; Peter M. Foley, Needham, all of Mass.

[73] Assignee: Reebok International Ltd., Stoughton, Mass.

[21] Appl. No.: 109,995

[22] Filed: Aug. 23, 1993

Related U.S. Application Data

[63] Continuation of Ser. No. 828,440, Jan. 31, 1992, abandoned.

[51] Int. Cl.[5] ..... A43B 7/06; A43B 7/14

[52] U.S. Cl. ..... 36/29; 36/28; 36/3 A; 36/71; 36/88

[58] Field of Search ..... 36/88, 89, 93, 28, 29, 36/3 A, 3 B, 114, 71, 117, 119, 86; 156/308.4, 275.1, 145; 12/142 R, 146 C, 142 P

[56] References Cited

U.S. PATENT DOCUMENTS

| | | | |
|---|---|---|---|
| 82,944 | 10/1868 | Haskins . | |
| 167,732 | 9/1875 | Blanchard . | |
| 536,345 | 3/1895 | Harris . | |
| 1,257,086 | 2/1918 | Marcellus . | |
| 1,940,542 | 12/1933 | Goth . | |
| 2,002,527 | 5/1935 | Dorogi et al. . | |
| 2,147,197 | 2/1939 | Glidden | 36/9 R |
| 2,205,938 | 6/1940 | Ward . | |
| 2,622,052 | 12/1952 | Chandler . | |
| 2,693,221 | 11/1954 | Lyijynen . | |
| 2,981,010 | 4/1961 | Aaskov . | |
| 3,015,414 | 1/1962 | Wilson . | |
| 3,196,062 | 7/1965 | Kristal . | |
| 3,221,932 | 12/1965 | Anderson . | |
| 3,256,131 | 6/1966 | Koch et al. . | |
| 3,329,983 | 7/1967 | Clamp . | |
| 3,397,418 | 8/1968 | Steadman et al. . | |
| 3,410,004 | 11/1968 | Finn | 36/93 |
| 3,484,881 | 12/1969 | Krieger . | |
| 3,642,563 | 2/1972 | Davis et al. . | |
| 3,658,208 | 4/1972 | Hansen . | |
| 3,685,176 | 8/1972 | Rudy | 36/93 |
| 3,739,414 | 6/1973 | Skelham . | |
| 3,744,159 | 7/1973 | Nishimura . | |

(List continued on next page.)

FOREIGN PATENT DOCUMENTS

| | | |
|---|---|---|
| 8305004 | 4/1985 | Brazil . |
| 0040189 | 11/1981 | European Pat. Off. . |
| 229273 | 7/1987 | European Pat. Off. . |
| 867585 | 5/1952 | Fed. Rep. of Germany . |
| 917173 | 1/1954 | Fed. Rep. of Germany . |
| 2005365 | 2/1970 | Fed. Rep. of Germany . |
| 2308547 | 2/1973 | Fed. Rep. of Germany . |
| 3205264 | 8/1983 | Fed. Rep. of Germany . |
| 3427644A1 | 7/1984 | Fed. Rep. of Germany . |
| 8802338 | 7/1989 | Fed. Rep. of Germany . |
| 601166 | 2/1926 | France . |
| 1204093 | 1/1960 | France . |
| 2180315 | 11/1973 | France . |
| 2356384 | 1/1978 | France . |
| 95419 | 2/1988 | Taiwan . |
| 26637 | of 1897 | United Kingdom . |
| 288671 | 4/1928 | United Kingdom . |

OTHER PUBLICATIONS

Superflate TM by Innovations in Cycling, Inc., *Interbike Buyer 1991 International Bicycle Expos*, p. 145.

*Primary Examiner*—Paul T. Sewell
*Assistant Examiner*—Marie Denise Patterson
*Attorney, Agent, or Firm*—Sterne, Kessler, Goldstein & Fox

[57] ABSTRACT

The present invention is an upper for an athletic shoe which substantially takes the form of an inflatable chamber. The upper is formed from first and second laminates which are welded together at various locations to form several fluid impervious chambers. The chambers, which are visible, are inflated with fluid to provide lightweight support and comfort to the foot of the wearer.

29 Claims, 15 Drawing Sheets

U.S. PATENTS DOCUMENTS

| | | | |
|---|---|---|---|
| 3,760,056 | 9/1973 | Rudy . | |
| 3,888,242 | 6/1975 | Harris et al. | 36/88 |
| 3,931,685 | 1/1976 | Laukaitis . | |
| 4,044,867 | 8/1977 | Fisher | 383/3 |
| 4,069,602 | 1/1978 | Kremer et al. . | |
| 4,083,127 | 4/1978 | Hanson . | |
| 4,222,183 | 9/1980 | Haddox | 36/45 |
| 4,232,459 | 11/1980 | Vaccari . | |
| 4,236,725 | 12/1980 | Bataille . | |
| 4,361,969 | 12/1982 | Vermonet | 36/29 |
| 4,372,297 | 2/1983 | Perlin . | |
| 4,458,429 | 7/1984 | Schmid . | |
| 4,508,582 | 4/1985 | Fink . | |
| 4,535,554 | 8/1985 | De Obaldia . | |
| 4,608,769 | 9/1986 | Sturlaugson . | |
| 4,628,945 | 12/1986 | Johnson, Jr. . | |
| 4,662,412 | 5/1987 | Swallert . | |
| 4,712,316 | 12/1987 | Baggio | 36/93 |
| 4,736,531 | 4/1988 | Richard . | |
| 4,744,157 | 5/1988 | Dubner | 36/88 |
| 4,773,454 | 9/1988 | Kroh et al. . | |
| 4,805,601 | 2/1989 | Eischen, Sr. . | |
| 4,811,497 | 3/1989 | Merino Ciudad . | |
| 4,817,303 | 4/1989 | Selbiger . | |
| 4,874,640 | 10/1989 | Donzis | 36/37 |
| 4,906,502 | 3/1990 | Rudy | 36/29 |
| 4,910,889 | 3/1990 | Bonaventure et al. . | |
| 4,912,861 | 4/1990 | Huang . | |
| 4,995,173 | 2/1991 | Spier | 36/29 |
| 4,999,072 | 3/1991 | Dischler | 36/29 |
| 5,012,954 | 5/1991 | Will . | |
| 5,113,599 | 5/1992 | Cohen et al. | 36/88 |
| 5,243,772 | 9/1993 | Francis et al. | 36/45 |
| 5,253,435 | 10/1993 | Auger et al. | 36/29 |

UPPER FOR AN ATHLETIC SHOE AND METHOD FOR MANUFACTURING THE SAME

This application is a continuation of application Ser. No. 07/828,440, filed Jan. 31, 1992 now abandoned.

FIELD OF THE INVENTION

This invention relates generally to athletic shoes and more particularly to an improved lightweight inflatable upper for an athletic shoe.

BACKGROUND OF THE INVENTION

Over the last decade, people have begun to realize the need for and benefits of physical activity. As such, aerobic exercise (i.e. physical activities which strengthen the-heart muscle) such as running, rope jumping and aerobic dance have become popular. As a result of this renewed interest in exercise, increased attention has been given to the development of athletic footwear. For example, it has recently become an objective of footwear manufacturers to develop a shoe which is lightweight yet supportive and comfortable.

Typically, an athletic shoe includes an upper, an insole, a midsole and an outsole. The upper covers and protects the instep, heel, and side portions of the foot and is commonly constructed of leather, canvas or synthetic material (e.g., nylon) or a combination thereof. The upper is secured to the foot of the wearer by a lacing means, a buckle system or a VELCRO ® closure system which overlies the wearer's foot in the instep area.

The particular sport for which the athletic shoe is chosen often dictates the material used to construct the upper. For example, the upper of a basketball shoe is constructed almost entirely of a heavy material such as leather because leather provides more support to the wearer's foot and ankle than canvas or nylon. A running shoe upper, however, is formed almost entirely of a synthetic material because such a material is lightweight, breathable and easy to clean. Depending on the material used to construct the upper, the typical shoe upper accounts for approximately 38–50% of total shoe weight.

The insole or insole board, which lies next to the foot under a sockliner, is the foundation of a shoe. It is that part of the shoe to which the upper is lasted and the sole attached. The insole may be made in one or two pieces and, for athletic shoes, is typically formed from particle board, cellulose board or other absorbent, lightweight material. To increase the flexibility of the insole board, some manufacturers provide transverse slits in the insole adjacent the metatarsal area. For a more flexible shoe, the upper may be sliplasted (as opposed to board lasted) by stitching a slip sock to the lasting margin of the upper. To complete formation of the shoe, the sliplasted upper is stitched or cemented to the shoe sole unit.

The midsole lies between the insole and outsole and is provided mainly to cushion the heel and forefoot of the wearer. Materials such as polyurethane (PU), ethyl vinyl acetate (EVA), polyester ethyl vinyl acetate (PEEVA), ELVALOY TM and more recently HYTREL foam are used to form the midsole. (HYTREL is a semi-crystalline, fully polyermized, high molecular weight, chemically stable, polyester elastomer composed of alternate amorphous and crystalline chains made by E. I. DuPont de Nemours and Co.) The midsole may be formed in one or more pieces and often includes a wedge or cushioning insert disposed beneath the heel of the wearer to effectively increase the amount of cushioning. During assembly, the midsole is typically bonded, either by cement or by fusion, to the insole of the shoe.

Finally, the outsole is that part of the shoe which comes into direct contact with the ground. The outsole is commonly molded from an abrasive resistant material such as rubber and is bonded or adhered to the bottom surface of the midsole to complete the shoe sole unit. The standard sole unit, consisting of the insole, midsole and Outsole, accounts for approximately 50–62% of total shoe weight.

In an effort to reduce the weight of athletic shoes, footwear manufacturers have, for the most part, focused their attention on decreasing the overall weight of the sole. One technique which has been employed to reduce shoe sole weight involves removing portions of the outsole which are not in direct contact with the ground or are otherwise not needed. U.S. Pat. No. Re. 33,066 to Stubblefield, for example, discloses a shoe sole where outsole material has been removed from beneath the metatarsal and rear heel portions of the foot.

More recently, shoe manufacturers have attempted to reduce the weight of shoes by forming the midsole from lower density synthetic foam materials. Although these foams are lighter in weight, they tend to break down more rapidly and sacrifice the amount of cushioning and support provided to the foot of the wearer.

Still another technique for reducing the weight of the sole involves removing an entire portion of midsole not specifically needed to cushion a particular area of the foot (e.g. the area beneath arch of the foot).

While some techniques are successful in reducing the weight of a sole without adversely effecting the performance of the shoe; little, if any, attention has been given to the upper of the shoe as a way of reducing total shoe weight.

On the other hand, efforts to increase the amount of support provided to the foot involve the use of orthotics, plastic inserts or reinforcing members in the uppers of shoes. For example, U.S. Pat. No. 4,813,158 to Brown discloses a mesh reinforcement member which provides added strength and lateral support to the upper of the shoe.

Plastic heel counters, which are now quite common in the shoe art, may be assembled within the shoe upper to provide increased lateral support to the heel and ankle of the wearer. Still another method of providing support to various areas of the foot involves the use of layered leather bands or straps.

More recently, athletic shoe manufacturers have turned to inflation systems situated within the upper as a means of increasing support to the foot. The system, when properly inflated, supportively conforms to the contour of the wearer's foot preventing movement of the foot within the shoe which could cause injury to the wearer's muscles or joints. The inflation system is assembled separately and is incorporated into the shoe between the upper and the interior shoe lining.

With each of the aforedescribed needs in mind, one objective of the present invention is to provide a lightweight upper which is securely fitted to the foot.

A further objective is to provide a lightweight upper which offers superior support to the foot of the wearer.

Still another objective is to provide a lightweight upper which offers customized support to the foot of the wearer.

Another objective is to provide an upper for an athletic shoe which moves with the foot of the wearer during increased activity.

A further objective is to provide an upper for an athletic shoe which keeps the user's foot comfortable and dry.

Still another objective is to provide an upper for an athletic shoe which is easily manufactured by requiring as little stitching as possible.

SUMMARY OF THE INVENTION

In accordance with the objectives and purposes of the present invention as embodied and described herein, the present invention is an upper for an athletic shoe which is lightweight and supportive to the foot of the wearer. The upper of the present invention is unique in that it takes the form of a plurality of inflatable chambers which form at least a portion of the outermost surface of the upper.

In one aspect of the invention, the upper is formed from a first laminate and a second laminate each of which are formed by adhering a flexible material to an elastic material. The first and second laminates are joined along their periphery to form a fluid impervious chamber which is inflated with air or gas to conform to the contour of the wearer's foot. The first laminate forms the outermost surface of the upper, while the second laminate forms the innermost surface. The upper further includes a relatively easy to manufacture fluid accepting means which is adapted to securely receive a fluid introducing means. The fluid accepting means efficiently functions as the fluid releasing means of the present invention as well.

In this particular embodiment, the elastic material is thermal-polyurethane film and the flexible material is a high power (stretch) nylon. The first and second laminates are preferably joined by radio frequency (rf) welding to create one or more fluid impervious chambers throughout the upper.

In another aspect of the invention, the upper is comprised of a fluid impervious chamber stitched to a flexible inner sock. The fluid impervious chamber is formed by joining a first laminate to a second laminate. The first laminate is comprised of a first flexible material and a first elastic material, while the second laminate is comprised of a second elastic material only. The first laminate forms at least a portion of the outermost surface of the upper, while the inner sock forms the innermost surface of the upper.

The upper of this embodiment also includes a combination fluid accepting/releasing means which is adapted to receive the fluid introducing means of the present invention.

The first and second laminates are preferably joined along their peripheral edges by rf welding to create the fluid impervious chamber. Although not specific to this particular embodiment, the fluid impervious chamber may include additional welds to control inflation Of the chamber avoiding discomfort to the foot of the wearer.

Furthermore, the upper may also include overlays made from an elastic material to provide additional support to various areas of the upper.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which.

DETAILED DESCRIPTION OF THE DRAWINGS

Figure 1:
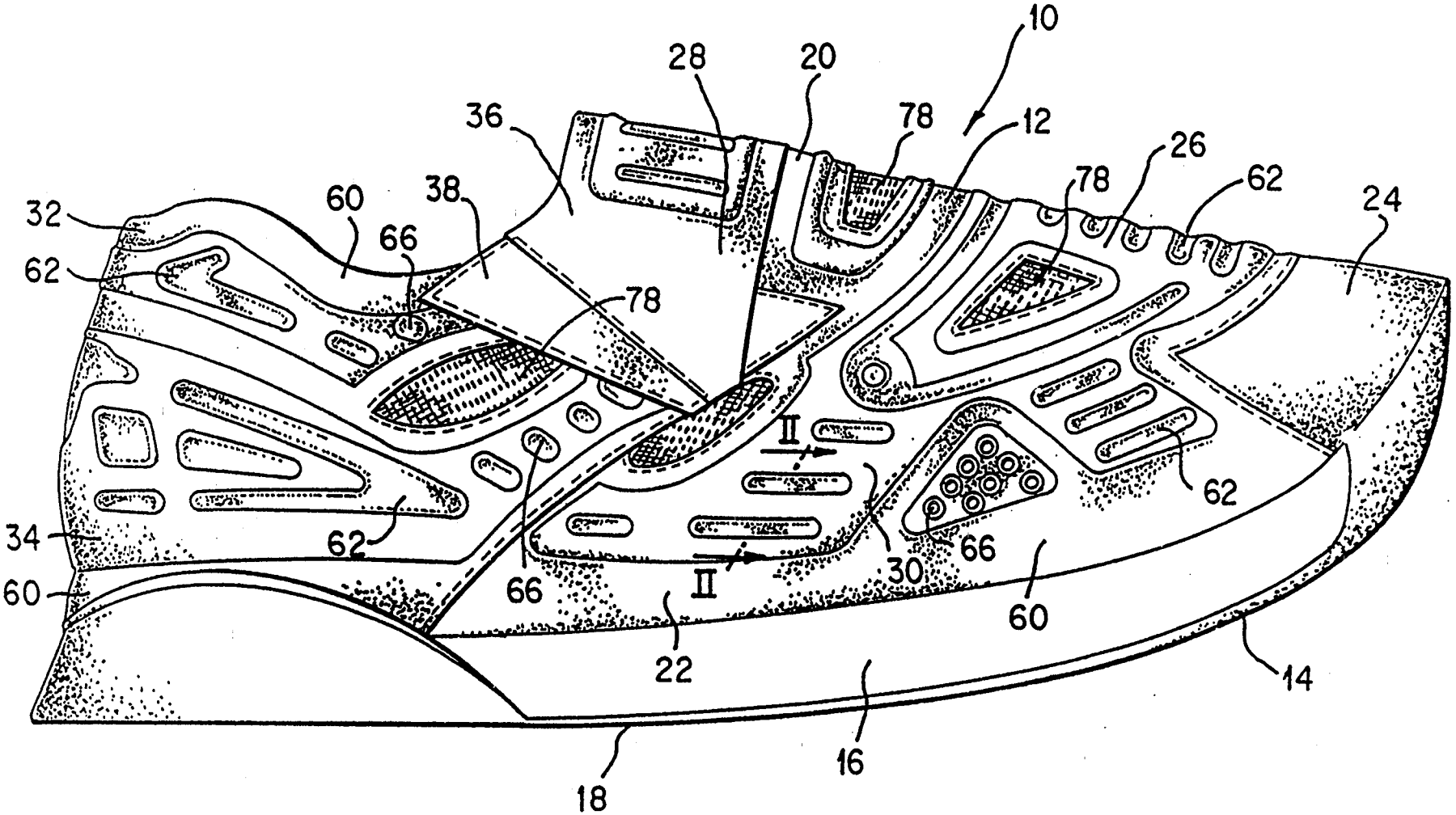
FIG. 1 is a left side elevational view of the upper of the present invention.

Referring initially to the embodiment illustrated in FIG. 1, an athletic shoe is shown generally at 10. Athletic shoe 10 includes the upper of the present invention 12 affixed to any type of sole 14 in a known manner. Sole 14 includes a ground engaging outsole 18 which is made of an abrasive resistant material such as rubber, for example. Disposed between outsole 18 and upper 12 is a midsole 16 which is typically made out of ethyl vinyl acetate (EVA) or polyurethane (PU). Although foam EVA and PU midsoles are well known in the shoe art, there are other possible midsole configurations and structures that could be used in conjunction with the upper of the present invention.

Similar to any conventional shoe upper, upper 12 includes a medial side 20, a lateral side 22, a toe region 24, a vamp region 26, an instep region 28, a quarter 30, an ankle region 32 and a heel region 34. Upper 12 is secured to the wearer's foot by a flap 36 located in instep region 28. Flap 36, which allows upper 12 to be easily donned by the wearer, is provided with a hook and pile type fastener, such as VELCRO®, at 38. Although a hook and pile type fastener is disclosed, any suitable closure system may be utilized with the upper of the present invention. Throughout upper 12, several ventilation windows 78 are provided which may be disposed in numerous locations. Ventilation windows 78 take the form of cut-outs which extend completely through upper 12. A mesh-like venting material is stitched to the underside of the upper beneath the cut-out so that air may pass through the ventilation window while preventing entry of particles or dust into the interior of the shoe. The venting material should possess enough stretch so that it moves with the foot of the wearer but will not tear away from the edges of the window during periods of continuous extreme movement.

By substantially taking the form of an inflatable chamber, upper 12 of the present invention is unique in that it provides customized support to the foot of the wearer while being lightweight.

Figure 2:
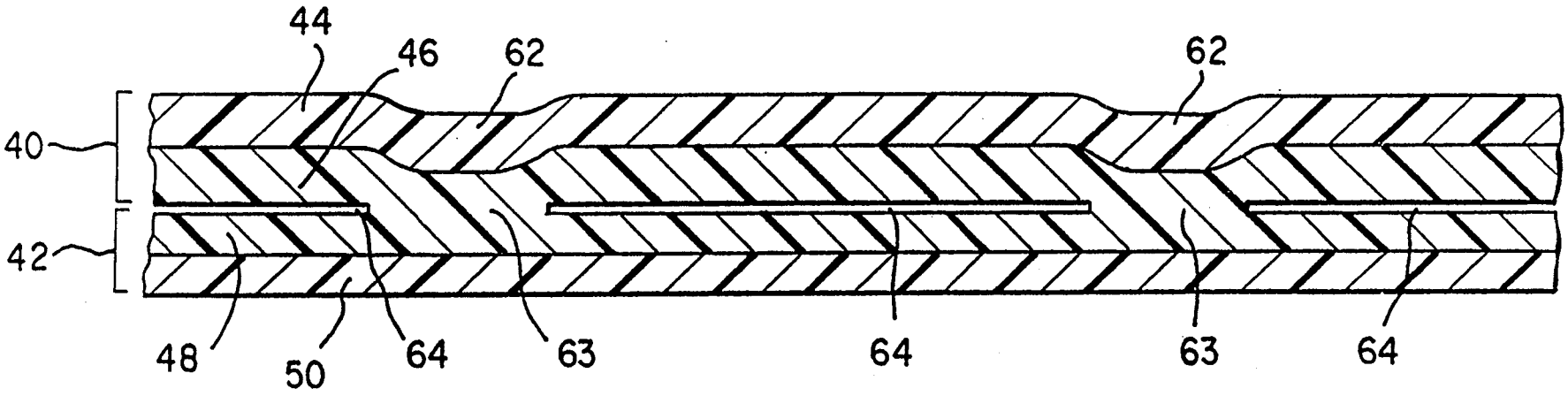
FIG. 2 is a cross-sectional view taken along line II—II in FIG. 1.

With reference now to FIG. 2, the construction of upper 12 will be described. Upper 12 is comprised of a first laminate or component 40 and a second laminate or component 42. First laminate 40 is comprised of a first lamina 44 and a coextensive second lamina 46. Second laminate 42 is comprised of a third lamina 48 and a coextensive fourth lamina 50. First lamina 44 forms the outermost surface of the upper, while fourth lamina 50 forms the innermost or foot-contacting surface.

First lamina 44 and fourth lamina 50 may be formed from any flexible, stretchable, lightweight material such as nylon, for example. LYCRA ®, available from E.I. DuPont de Nemours and Co., Wilmington, Del., is an especially suitable material for first lamina 44 as it exhibits each of the aforementioned characteristics and is easily cleaned. Preferably, the material from which fourth lamina 50 is formed should also be able to wick moisture away from the foot of the wearer to keep the wearer's foot comfortable and dry during periods of increased activity. COOLMAX, another product available from E.I. DuPont de Nemours and Co., is an appropriate fabric for fourth lamina 50 as it exhibits superior wicking abilities.

Second lamina 46 and third lamina 48 form the innermost layers of the upper and are made from a fluid impervious elastic material, such as thermalpolyurethane (TPU) available from Dow Chemical Company, product number 2103 80A. In the preferred embodiment, second and third laminae 46 and 48 are each approximately 10–15 mils thick. In areas of the foot where more support or rigidity is required (e.g. the heel, instep and quarter regions), the thickness of the second and third laminae is greater, approximately 12 mils. Additional rigidity or strength may be provided to the upper by embedding polyester (or monoester) filaments in second lamina 46. As will be discussed in greater detail below, second lamina 46 and third lamina 48 are joined to form various inflatable chambers which substantially make up upper 12.

First laminate or component 40 is formed by joining first lamina 44 to second lamina 46. The coextensive first and second laminae may be joined using any adhesive which is capable of withstanding high temperatures. Second laminate or component 42 is formed in a similar manner by joining third lamina 48 to coextensive fourth lamina 50. If desired, a quilted material may be inserted between third lamina 48 and fourth lamina 50 to provide additional cushioning and comfort to the foot of the wearer.

In this particular embodiment, upper 12 is formed by cutting identical patterns from first laminate 40 and second laminate 42. The first and second laminate patterns may take the overall shape of the upper shown in FIG. 3 or the upper may be formed using individual component parts. To complete formation of a one-piece pattern upper, first laminate 40 is placed on top of coextensive second laminate 42 and is attached thereto along a periphery weld line 60 (see FIGS. 1 and 3). At this point, periphery weld line 60 forms a single fluid impervious interior chamber which is capable of containing a fluid medium such as air or gas. One example of a suitable method of attachment of first laminate 40 to second laminate 42 is by application of radio frequency (rf) energy to the peripheral edge of upper 12.

As shown in FIG. 1, a plurality of interior weld lines 62 are also provided throughout upper 12 to further attach first laminate 40 to second laminate 42. These interior weld lines are also formed by rf welding and define individual interior channels 64 within the larger inflatable chambers. As illustrated in FIG. 2, where the first and second laminates are welded together (as at weld line 62), second lamina 46 and third lamina 48 bond or fuse to form a fluid impervious barrier 63. Thus, fluid introduced into interior chamber 64 is prevented from leaking out.

A plurality of circular welds 66 may also be provided throughout upper 12. Circular welds 66 together with interior weld lines 62 control the thickness of the chambers when they are in their inflated state (i.e. when air or gas is introduced into the chambers). It is preferred that, when inflated, chamber 64 be no more than 10 millimeters thick to prevent "bubbling" which could cause discomfort to the foot of the wearer. In regions of upper 12 where it is desirable to have the upper inflated to a maximum thickness, the concentration or density of circular welds 66 and interior weld lines 62 is low. For example, where there are large spaces between the shoe and the foot, it is desirable to inflate interior chamber 64 to a greater thickness; hence, the density of weld lines and/or circular welds provided in this area is low. Furthermore, weld lines 62 and circular welds 66 should be placed throughout the upper so that they coincide with the bones and muscles of the foot to provide maximum comfort and support to the foot of the wearer.

Figure 3:
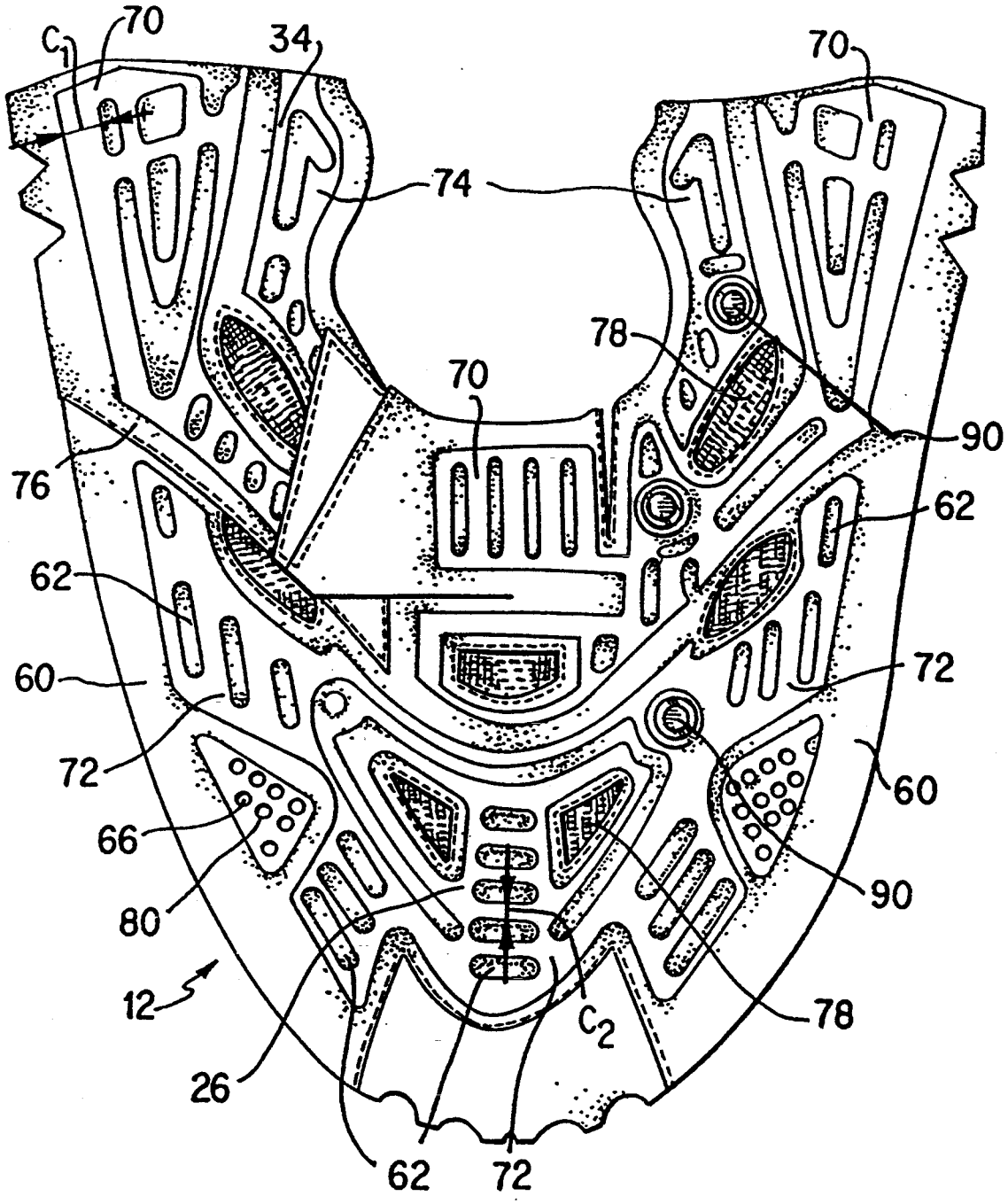
FIG. 3 is a top plan view of the upper shown in FIG. 1.

Turning now to FIG. 3, the upper of FIG. 1 is shown in top plan view. In this embodiment, upper 12 includes three distinctive fluid impervious chamber compartments. These compartments include a heel and instep chamber 70, a vamp and quarter chamber 72, and an ankle collar chamber 74. The chambers may be formed directly on a one-piece upper pattern or they may be formed individually from first and second laminate units. When the chambers are formed individually, they are dielectrically cut to the appropriate shape and are stitched together, as at 76, or are welded together by rf energy to create a complete upper.

As shown in FIG. 3, the density of interior weld lines 62 in vamp region 26 is particularly high. This is so because it is not desirable for vamp chamber 72 to obtain a thickness which would place too much pressure on the phalanges of the foot. Only minimal support is needed in this area; thus, the concentration of interior weld lines 62 is great. Conversely, the heel (especially the area about the lower calcaneus) requires a great amount of support to prevent movement of the heel within the shoe which could cause injury to the foot and leg of the wearer. Accordingly, the concentration of interior weld lines 62 in heel area 34 is low to moderate. Because there is a decreased number of weld lines in heel area 34, the individual fluid channels of heel chamber 70 are capable of accepting a relatively large volume of air which will provide increased support to the heel of the wearer. As can be seen in FIG. 3, the width of fluid channel $C_1$ located in heel region 34 is greater than the width of fluid channel $C_2$ located in vamp region 26. As such, the amount of support which may be supplied to the heel region is greater than that which may be supplied to the vamp. Obviously, in other areas of the foot where increased support is required (e.g. the arch area) the concentration of interior weld lines 62 will be low. Furthermore, the interior weld lines of the upper shown in FIG. 3 are positioned so that upper 12, when inflated, comfortably conforms to the contour or shape of the wearer's foot.

The upper of FIG. 3 also includes several aeration holes 80 which are formed by punching through the center portion of circular welds 66. Because the welds are circular and do not enable air to pass therethrough, the aeration holes can be formed within the center portion of the weld without risk of air or gas leakage.

To inflate upper 12, chambers 70, 72 and 74 are each provided with a fluid accepting means 90 which transfers fluid from a fluid source to a chamber. As will be discussed below, fluid accepting means 90 also functions as the fluid release mechanism of the present invention.

Figure 4:
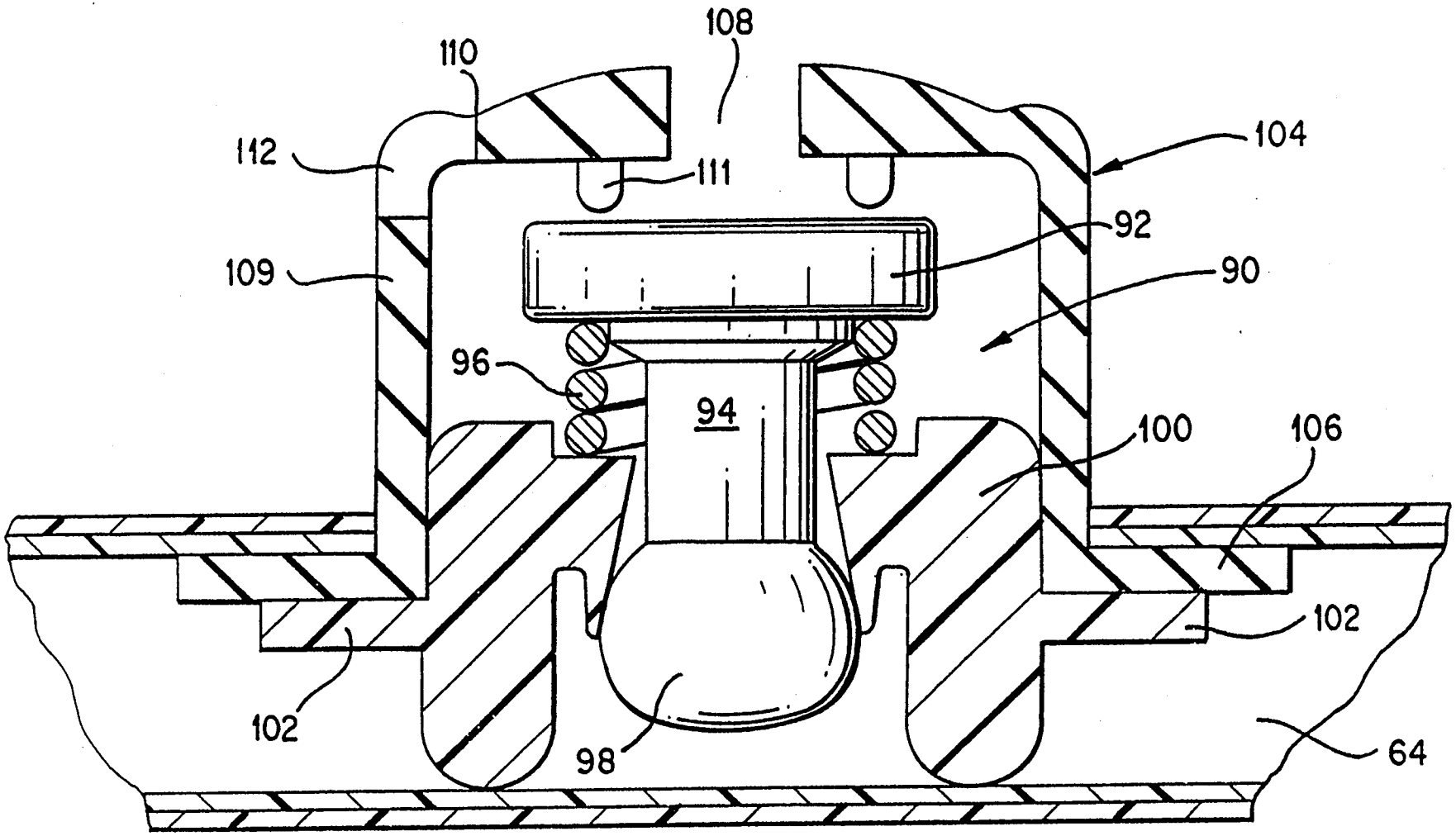
FIG. 4 is a cross-sectional view of the fluid accepting means of the present invention.

With reference now to FIG. 4, a fluid accepting means 90 is shown in direct fluid communication with an interior chamber 64. Fluid accepting means 90 may be located anywhere along the outer surface of the chamber; however, it is preferably disposed on lateral side 22 of shoe 10 so that contact with the fluid accepting means of the opposite shoe may be prevented.

Fluid accepting means 90 includes a plunger 92 surrounded by an annular shoulder 100. Plunger 92 includes a stem 94 surrounded by a biasing spring 96, and a stopper 98. When fluid accepting means 90 is not accepting fluid, spring 96 biases plunger 92 in the shown closed position. In the closed position, stopper 98 abuts against annular shoulder 100 so that fluid within the chamber is prevented from escaping. When fluid accepting means 90 is in the open or fluid accepting position, stopper 98 is forced away from annular shoulder 100 and fluid from a fluid source is allowed to pass into interior chamber 64. Plunger 92, stem 94 and stopper 98 may be made from aluminum or hard plastic. Annular shoulder 100 is made from a TPU product (such as ESTANE TM made by B.F. Goodrich Product Number 58-863) so that it may be rf welded to other elements of the upper as at extension 102.

Figure 4A:
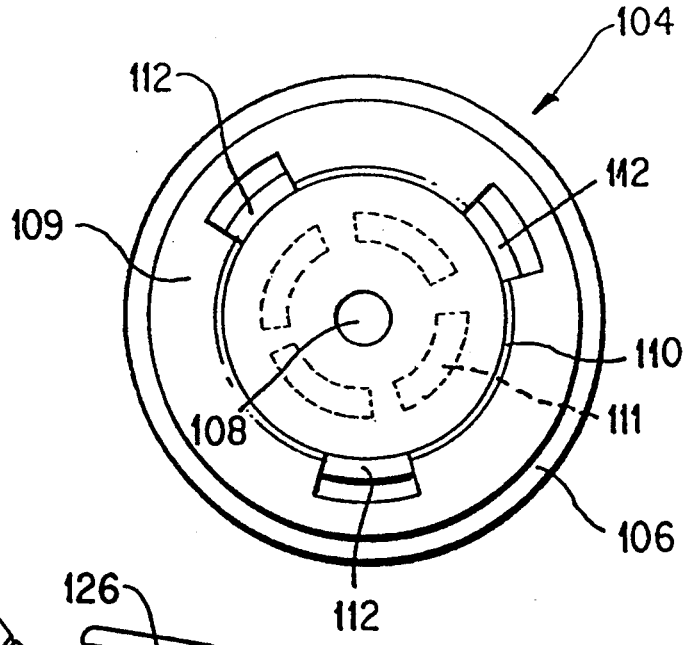
FIG. 4A is a top plan view of the fluid accepting means cover.

Fluid accepting means 90 is surrounded by a protective cover 104 (see FIGS. 4 and 4A) which is preferably molded from TPU/ESTANE TM. Cover 104 includes a flange 106, a central aperture 108, a side wall 109, a depression groove 110, several plunger engaging protections 111, and several fluid escaping apertures 112. The vertical positioning of side wall 109 is such that it will matingly engage with the nozzle of a fluid introducing means (discussed below) in a fluid-tight manner.

Cover 104 is secured to fluid accepting means 90 so that it projects from the surface of upper 12 at an angle of approximately 90°. This allows easy inflation of upper 12 as the hand of the user is naturally and comfortably positioned against upper 12 to inflate the same. Cover 104 may be rf welded to fluid accepting means 90 at flange 106 or it may be bonded to upper 12 using a suitable chemical solvent.

Central aperture 108 is provided so that fluid from the fluid introducing means may enter fluid accepting means 90. Depression groove 110 allows cover 104 to invert when a force to release fluid from the fluid-accepting means is applied thereto. As cover 104 is depressed, plunger engaging projections 111 come into contact with plunger 92 to assist in opening fluid accepting means 90.

Figure 5:
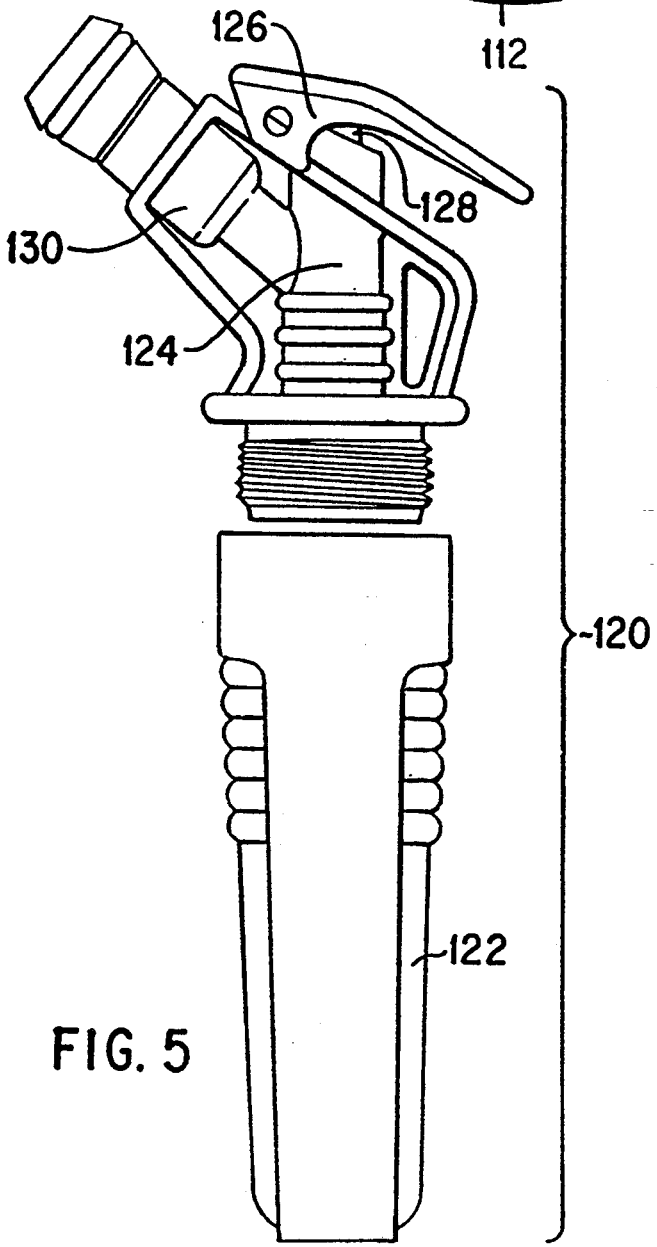
FIG. 5 is a right side elevational view of the fluid introducing means of the present invention.
Figure 5A:
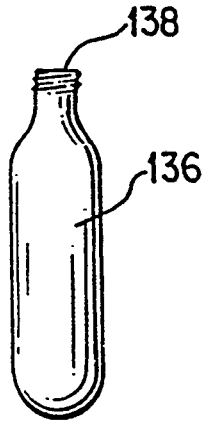
FIG. 5A is a side elevational view of a fluid cartridge.

Fluid, preferably carbon dioxide ($CO_2$) gas, is introduced into the inflatable chambers of the upper by a pressurized fluid introducing means 120. A suitable fluid introducing means for inflating the upper of the present invention is manufactured by Innovations in Cycling of Tucson, Ariz. As shown in FIG. 5, fluid introducing means 120 includes a hollow cartridge housing 122, a head unit 124, a hinged lever 126, and a nozzle 130. Head unit 124 further comprises a valve assembly (not shown) and a plunger 128 which operates the valve assembly to allow pressurized gas to enter the head unit. The hollow cartridge housing 122 is adapted to receive a $CO_2$ gas cartridge 136 shown in FIG. 5A.

Figure 6:
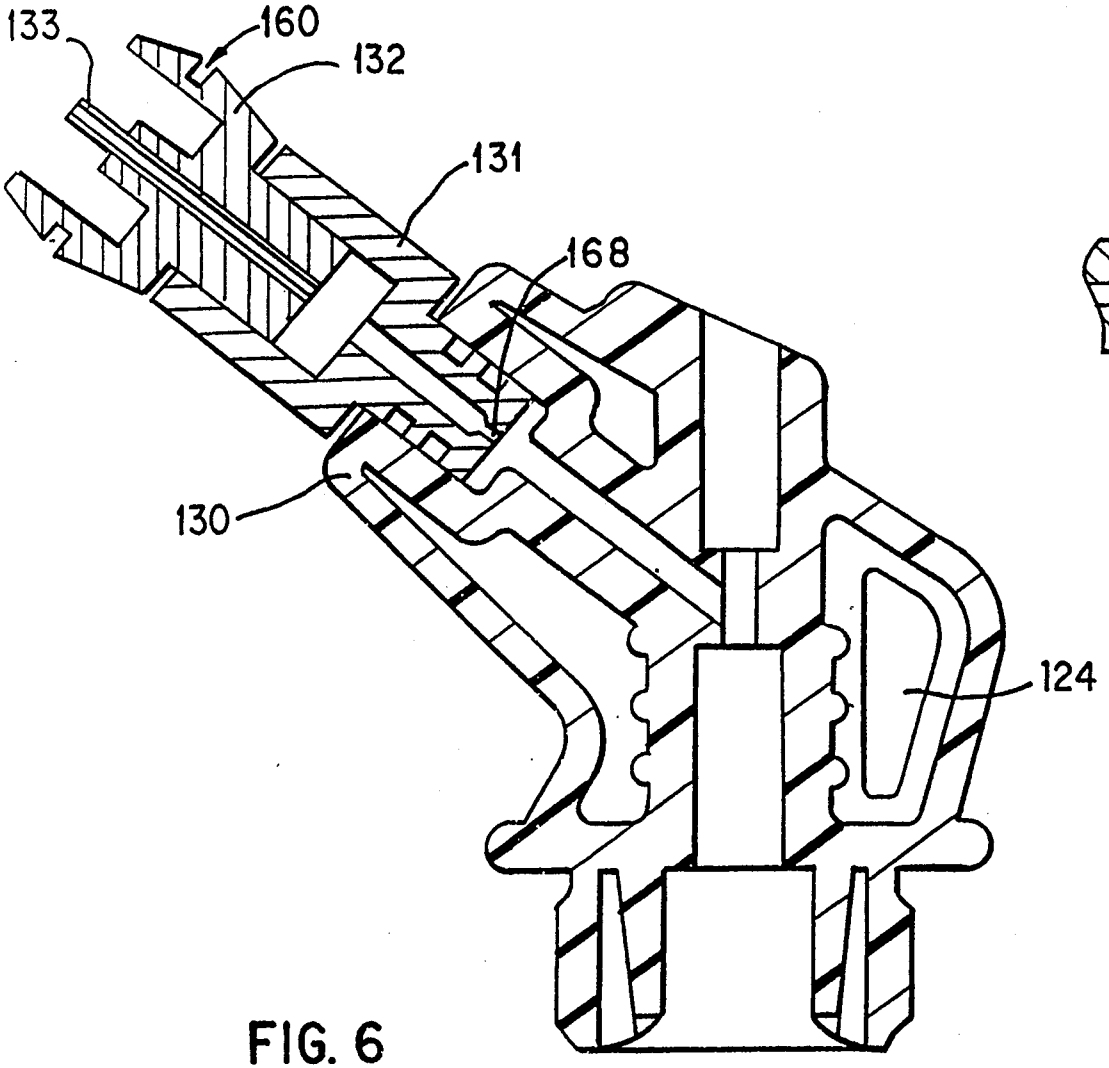
FIG. 6 is a cross-sectional view of the head unit of the fluid introducing means.

As shown in FIG. 6, nozzle 130 is further provided with a restricter valve 131 and an adaptor 132. Restricter valve 131 is preferably made from aluminum and is snap fitted and anchor pinned into nozzle 130 at its distal end. The restricter valve is provided to lower the pressure of the gas (as at 168) flowing through head unit 124. By lowering the pressure of the gas, the chance of accidental injury to the user and damage to the inflatable bladder is decreased.

Adaptor 132 is provided to matingly engage with cover 104 of fluid accepting means 90. Adaptor 132 is also preferably made from aluminum and includes a hollow depressor pin 133. The interior surface and diameter of adaptor 132 is such that it pressure fits onto cover 104 in a fluid-tight manner. When the adaptor is properly fitted onto cover 104, the seal between adaptor 132 and cover 104 is fluid-tight and depressor pin 133 is able to come into contact with plunger 92 through central aperture 108. As depressor pin 133 comes into contact with plunger 92, fluid accepting means 90 is opened.

Figure 7:
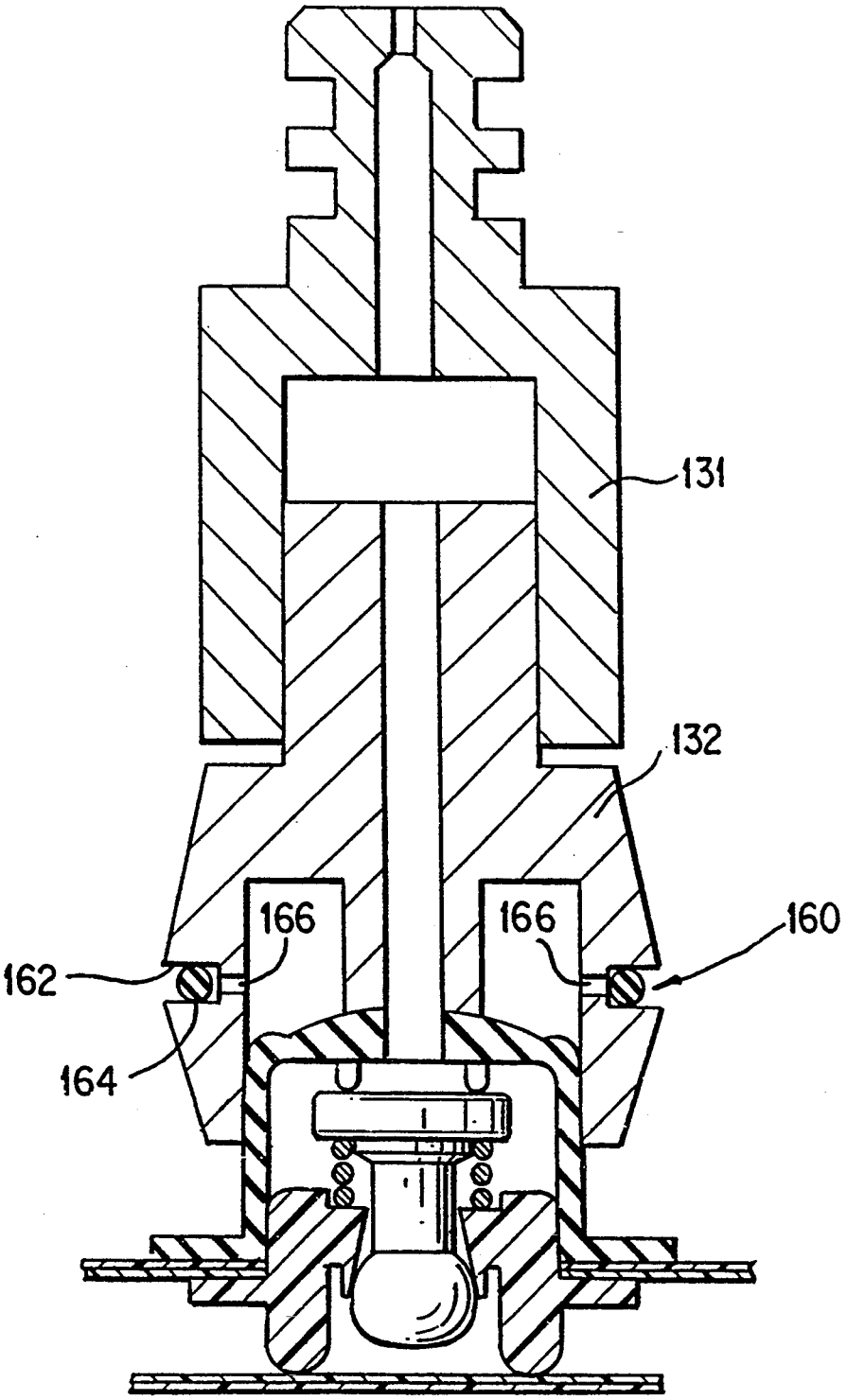
FIG. 7 is a cross-sectional view of the restricter valve and adaptor of the fluid introducing means.

Adaptor 132 is also provided with a "blow off" mechanism 160 which allows pressurized fluid to flow out of upper 12 when the pressure within the chamber becomes too great (e.g. when the pressure is greater than 10 psi). As shown in FIG. 7, adaptor 132 includes an "O-ring" seat 162 which receives an O-ring 164. Behind O-ring seat 162, adaptor 132 is provided with several apertures 166. When the pressure within the chamber exceeds 10 psi, for example, the pressure within the chamber overcomes the resistance of O-ring 164. As O-ring 164 is pushed away from its seat 162, fluid within the chamber exits the adaptor through the apertures 166.

Figure 8:
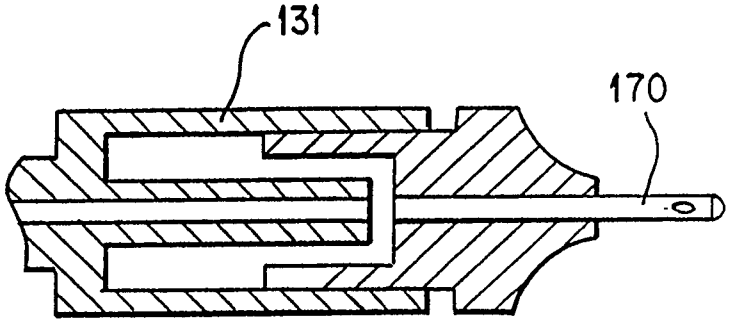
FIG. 8 is a cross-sectional view of a ball inflating needle unit.

Adaptor 132 is removably fitted into restricter valve 131 by threading means or other conventional fitting means. If desired, adaptor 132 may be replaced with a ball inflating needle unit 170 as shown in FIG. 8.

The operation of fluid introducing means 120 with respect to the upper of the present invention will now be described. With cartridge 136 properly inserted within housing 122, head unit 124 is threaded thereonto. As head unit 124 is screwed into housing 122, a tubular puncturing pin or lancet (not shown) punctures a sealing membrane 138 to open cartridge 136. A sealing gasket, valve ball and biasing spring (not shown) within head unit 124 prevent high pressure $CO_2$ gas from inadvertently escaping from fluid introducing means 120.

Fluid introducing means 120 is then brought to fluid accepting means 90 and adaptor 132 is snugly pressure fitted onto cover 104. If adaptor 132 is not properly fitted over cover 104, depressor pin 133 will not engage with plunger 92 to allow gas to enter the fluid accepting means.

With adaptor 132 fitted in a fluid-tight manner over cover 104, depressor pin 133 passes through central aperture 108, depressing plunger 92 to open fluid accepting means 90. That is, stopper 98 is forced away from annular shoulder 100 to open the fluid accepting means. The user then presses down on lever 126 so that it comes into contact with plunger 128. As plunger 128 is depressed, the central channel (not shown) within head unit 124 opens and $CO_2$ gas passes through nozzle 130, restricter valve 131 and adaptor 132. As $CO_2$ gas leaves valve pin 133, it enters fluid accepting means 90 through central aperture 108 where it flows into interior chamber 64 to inflate upper 12. When the upper has been inflated to the desired level, fluid introducing means 120 is removed and spring 96, in a biasing action against plunger 92, brings stopper 98 into contact with annular shoulder 100 to close fluid accepting means 90. At this time, fluid within the fluid impervious chamber is prevented from leaking out of the chamber through fluid accepting means 90. If the pressure within the chamber is too great, fluid will "bleed off" or exit the adaptor through blow-off mechanism 160.

When the user wishes to deflate the upper, he simply depresses (or otherwise inverts) cover 104 to depress plunger 92. As stopper 98 moves away from annular shoulder 100, fluid accepting means 90 opens and fluid from within the chamber is released exiting the upper through fluid escaping apertures 112. Thus, the fluid accepting means of the present invention efficiently functions as the fluid releasing means as well.

Figure 9:
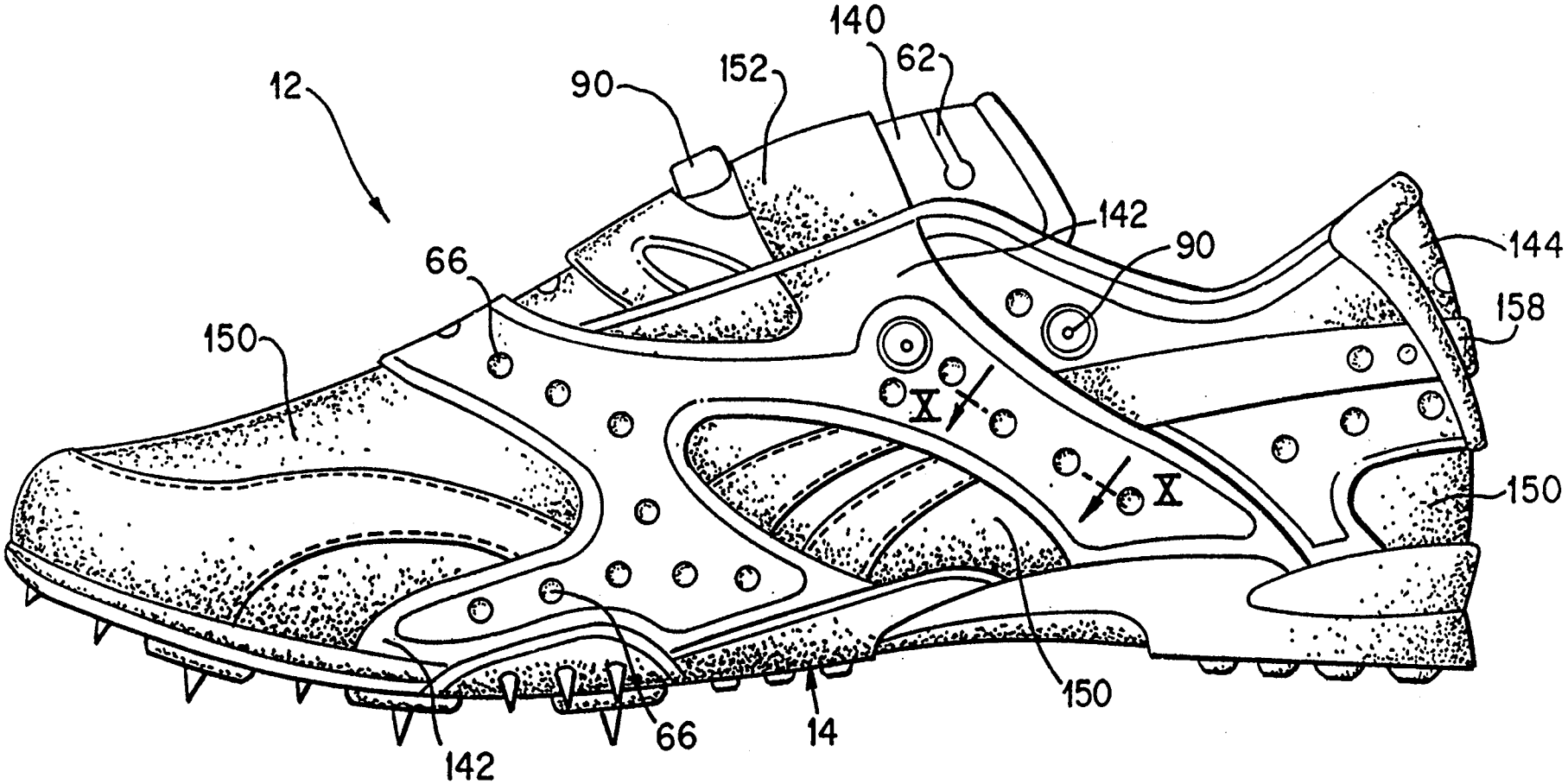
FIG. 9 is a right side elevational view of an alternate embodiment of the present invention.

Turning now to FIG. 9, an alternate embodiment of the upper shown in FIGS. 1 and 3 is shown. Although this particular embodiment is constructed in a manner different from that of FIGS. 1 and 3, it accomplishes the same objective of providing a lightweight, supportive upper for an athletic shoe.

Upper 12 of FIG. 9 is shown attached to a spiked sole 14 to form a lightweight track shoe. The upper of FIG. 9 is distinguished from the upper of FIGS. 1 and 3 in that it is more like a form-fitting sock having various inflatable, as well as noninflatable, areas. In order to form a better fitting, more supportive upper, the inflatable chambers of upper 12 are made separately and joined to the remainder of upper material to form the novel upper of the present invention.

Figure 10:
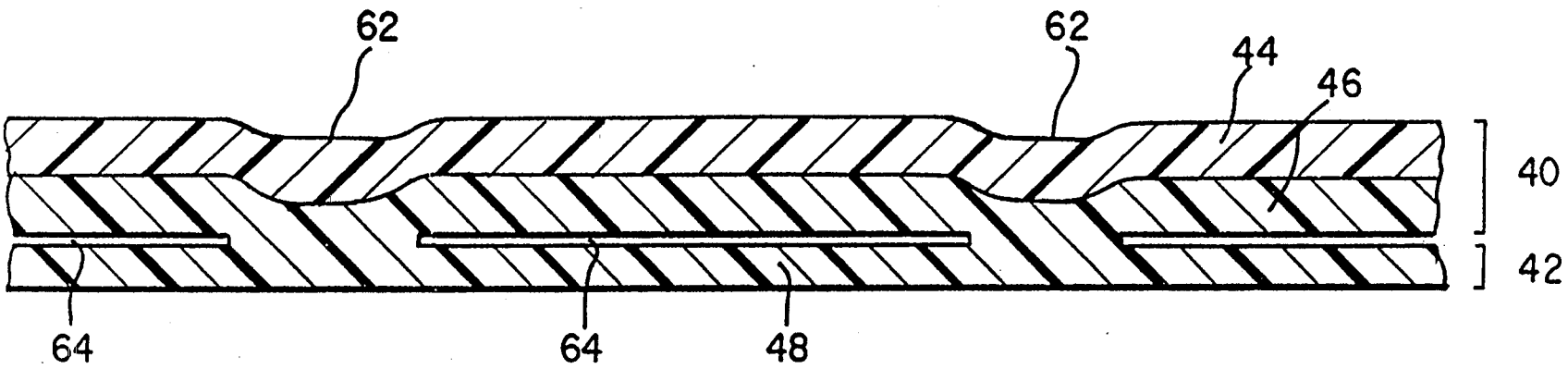
FIG. 10 is a cross-sectional view taken along line X—X in FIG. 9.

The embodiment shown in FIG. 9 includes a tongue chamber 140, an instep/quarter chamber 142, and a heel/collar chamber 144. With reference to FIG. 10, individual inflatable chambers 64 are shown formed from a first laminate or component 40 and a second laminate or component 42. First laminate 40 is comprised of a first lamina 44 and a coextensive second lamina 46. Unlike the embodiment shown in FIGS. 1 and 3, however, second laminate 42 is comprised only of third lamina 48, as fourth lamina 50 is no longer needed due to the unique construction of upper 12 which will be described in detail below.

Similar to the embodiment of FIGS. 1 and 3, first lamina 44 may be formed from any flexible, stretchable, lightweight material such as nylon, for example. Second lamina 46 and third lamina 48 may be made from the same TPU product (ESTANE TM) described with regard to FIGS. 1 and 3. The second and third laminae are each approximately 10–15 mils thick and may be impregnated with polyester or monoester filaments for additional strength and support.

First laminate 40 is formed by joining first lamina 44 with second lamina 46. The coextensive first and second laminae are joined using any suitable adhesive capable of withstanding high temperatures. The inflatable chambers are formed by cutting identical patterns from first laminate 40 and second laminate 42. Pattern 146 shown in FIG. 11 may be used to construct the inflatable chambers of the upper shown in FIG. 9 or each chamber may be patterned separately and later stitched together. To complete formation of the inflatable chambers, first laminate 40 is placed on top of coextensive second laminate 42 and is attached thereto along peripheral edge 148 of the pattern. This peripheral weld line forms a single fluid impervious chamber which is capable of containing air or gas. Preferably, first laminate 40 is attached to second laminate 42 using rf energy.

Figure 11:
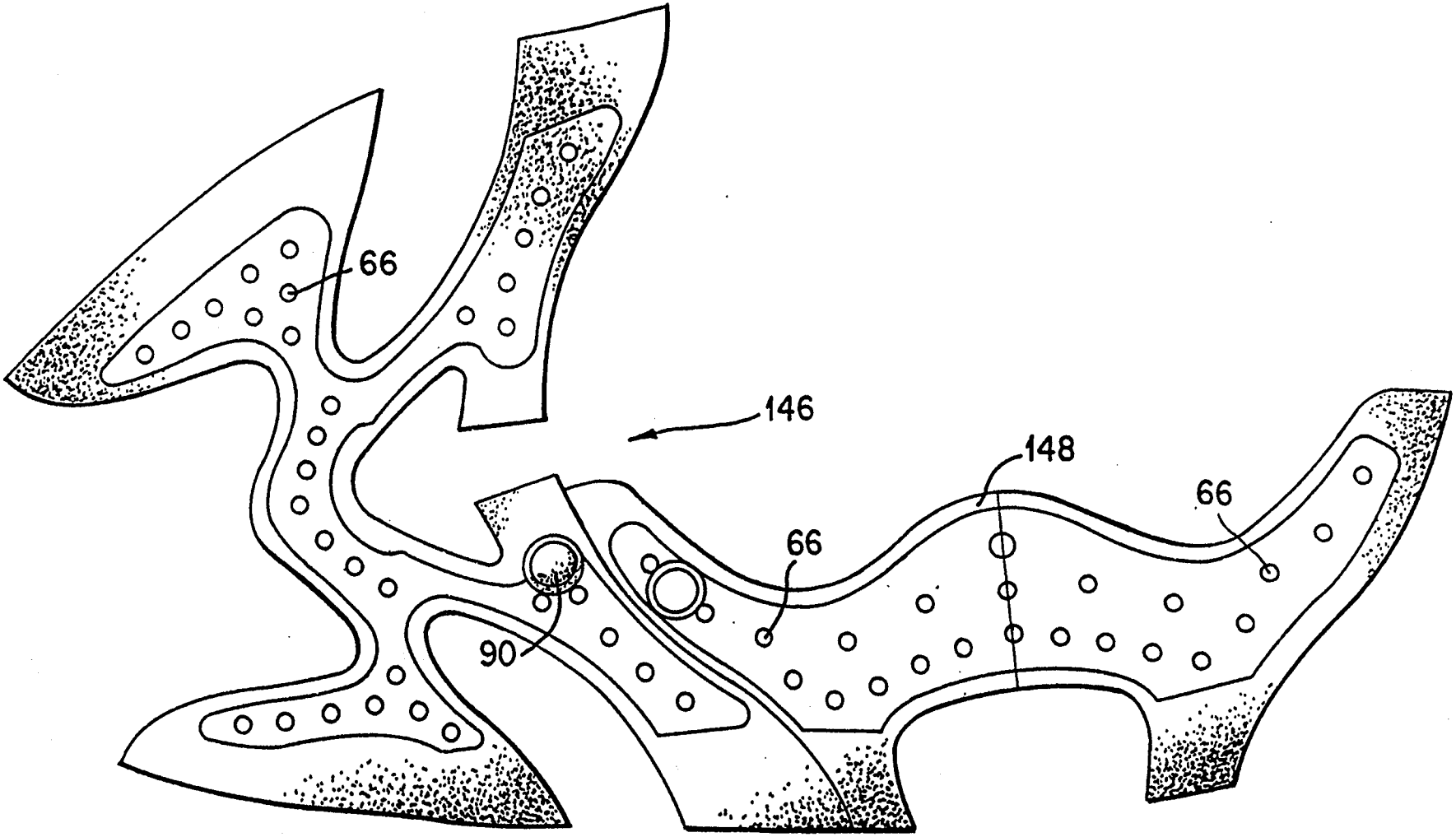
FIG. 11 is a top plan view of a pattern for forming the inflatable chamber(s) of the upper shown in FIG. 9.

As shown in FIGS. 9, 10 and 11, the inflatable chambers may be provided with a plurality of interior weld lines 62 and/or circular welds 66 to avoid uncomfortable over-inflation of the chambers. Again, interior weld lines 62 and circular welds 66 are formed by rf welding within the peripheral edge of the chamber. Depending upon how the chambers are formed (that is, whether they are formed separately or on a single pattern), additional weld lines may be used to create and seal distinct inflatable chambers (for example, quarter chamber 142 or heel chamber 144). Additionally, each inflatable chamber of the upper is provided with a fluid accepting/fluid releasing means 90 which is formed and functions in a manner heretofore described.

Figure 12:
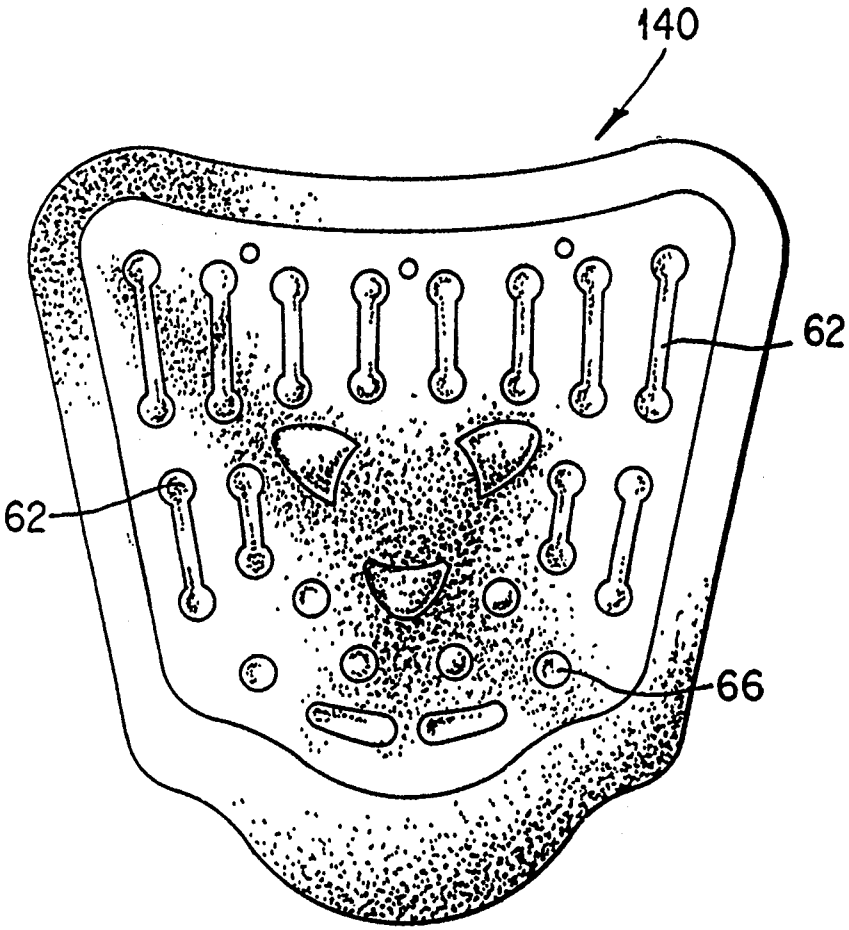
FIG. 12 is a front elevational view of an inflatable tongue chamber.

In this particular embodiment, tongue chamber 140 is formed separately using the following method. With reference to FIG. 12, tongue chamber 140 is formed by joining first laminate 40 to second laminate 42. For the tongue chamber only, third lamina 48 is joined to a coextensive fourth lamina 50 which is formed from a nylon venting material having a suitable amount of stretch. First laminate 40 is welded to second laminate 42 along the peripheral edge to form the fluid impervious chamber 140. Additional weld lines 62 and circular welds 66 are provided within the periphery to control and limit inflation of the tongue chamber. Although not shown in FIG. 12, tongue chamber 140 is provided with its own fluid accepting/fluid releasing means 90 which allows fluid to enter or exit the chamber when desired.

To complete the formation of upper 12, the inflatable chambers are incorporated in the following manner. Inflatable chambers 140, 142 and 144 are positioned on a one-piece inner sock 150 (FIG. 9) and are stitched thereto through their peripheral welded edges 148. Inner sock 150 is preferably formed from a breathable, lightweight, stretchable material such as SPANDEX TM, manufactured by E.I. DuPont de Nemours and Co. If desired, inner sock 150 may be backed with a foam or quilted material to increase the amount of comfort provided to the wearer's foot. Inner sock 150 with chambers 140, 142 and 144 stitched thereto is then placed on an anatomically detailed last where it is slip or board lasted to complete formation of the entire shoe. By lasting the shoe on such an anatomically detailed last, the upper (being constructed of highly flexible materials) easily follows the shape of the last and is capable of supportively conforming to the natural contour of the wearer's foot when worn.

Figure 13:
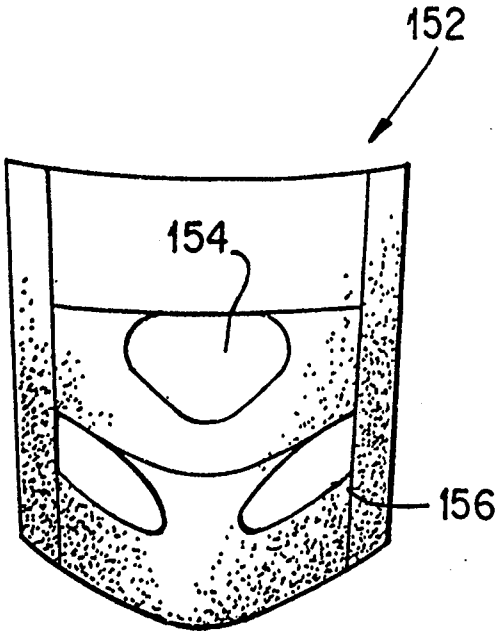
FIG. 13 is a front elevational view of a tongue overlay.

To increase the amount of support to the portion of the foot beneath the tongue, the tongue may be provided with a stretch TPU overlay 152 as shown in FIGS. 9 and 13. Overlay 152 is provided with an aperture 154 which allows a fluid accepting/releasing means 90 to extend therethrough. Overlay 152 is injected with a TPU resin (such as one manufactured by Advanced Resin Technologies) for additional stretch and shape retention and is attached along its peripheral edge 156 to tongue chamber 140 by conventional stitching. Overlay 152 is especially unique in that it also functions to secure the upper to the foot of the wearer and effectively eliminates the need for any other type of closure mechanism, such as a lacing or VELCRO® flap.

Figure 14:
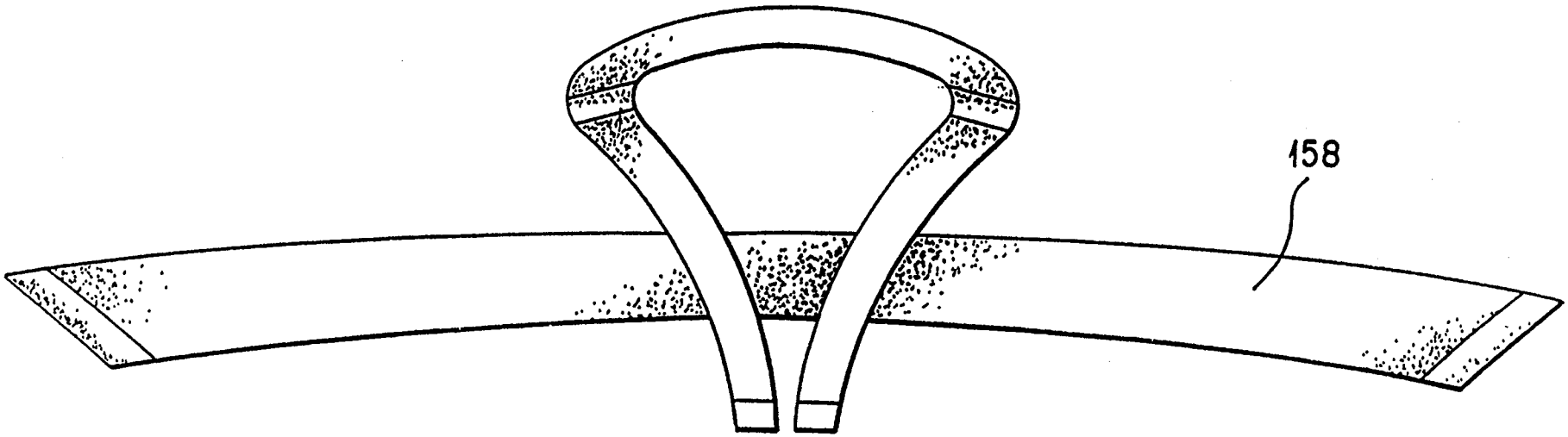
FIG. 14 is a front elevational view of a heel overlay.

Still another resin-injected TPU overlay 158 is shown in FIGS. 9 and 14. Heel overlay 158 functions to bring heel chamber 144 in close to the heel and assists upper 12 in conforming to the achilles tendon area of the foot for a secure yet comfortable fit. Other resin-injected TPU overlays may be provided where additional support or conformity to the foot is required or desired.

The inflatable chambers of the embodiment shown in FIG. 9 are inflated by engaging the fluid introducing means previously described with the various fluid accepting means provided throughout the upper. Likewise, fluid is released from the chambers in the same manner described heretofore.

Figure 15:
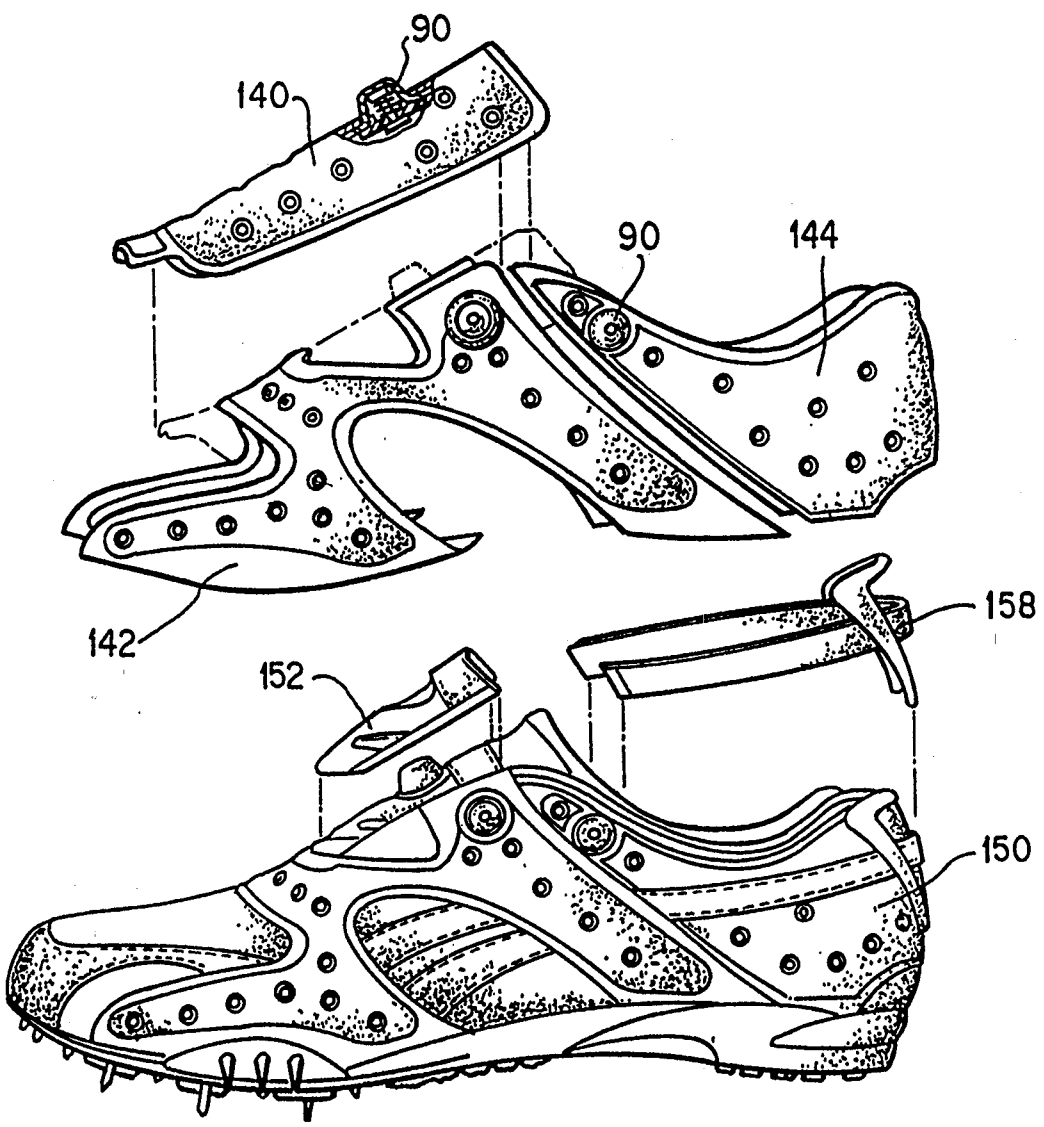
FIG. 15 is an exploded view of the elements of the upper shown in FIG. 9.

FIG. 15 illustrates an exploded view of the elements of the upper shown in FIG. 9. As shown in this figure, the inflatable chambers and resin-injected TPU overlays are formed individually and are stitched to the inner sock 150 at optimal locations. Thus, the upper of FIG. 9 is extremely lightweight as it is formed partially from lightweight inflatable chambers and partially from lightweight fabric. Moreover, the upper also provides a high amount of support as the inflated chambers, lightweight elastic fabric and TPU overlays supportively conform to the contour of the wearer's foot.

Although the embodiments of FIGS. 1 and 9 are shown having three inflatable chamber compartments, it should be realized that the upper of the present invention may have as many or as few chamber compartments as the particular sport for which the shoe is used demands.

Figure 16:
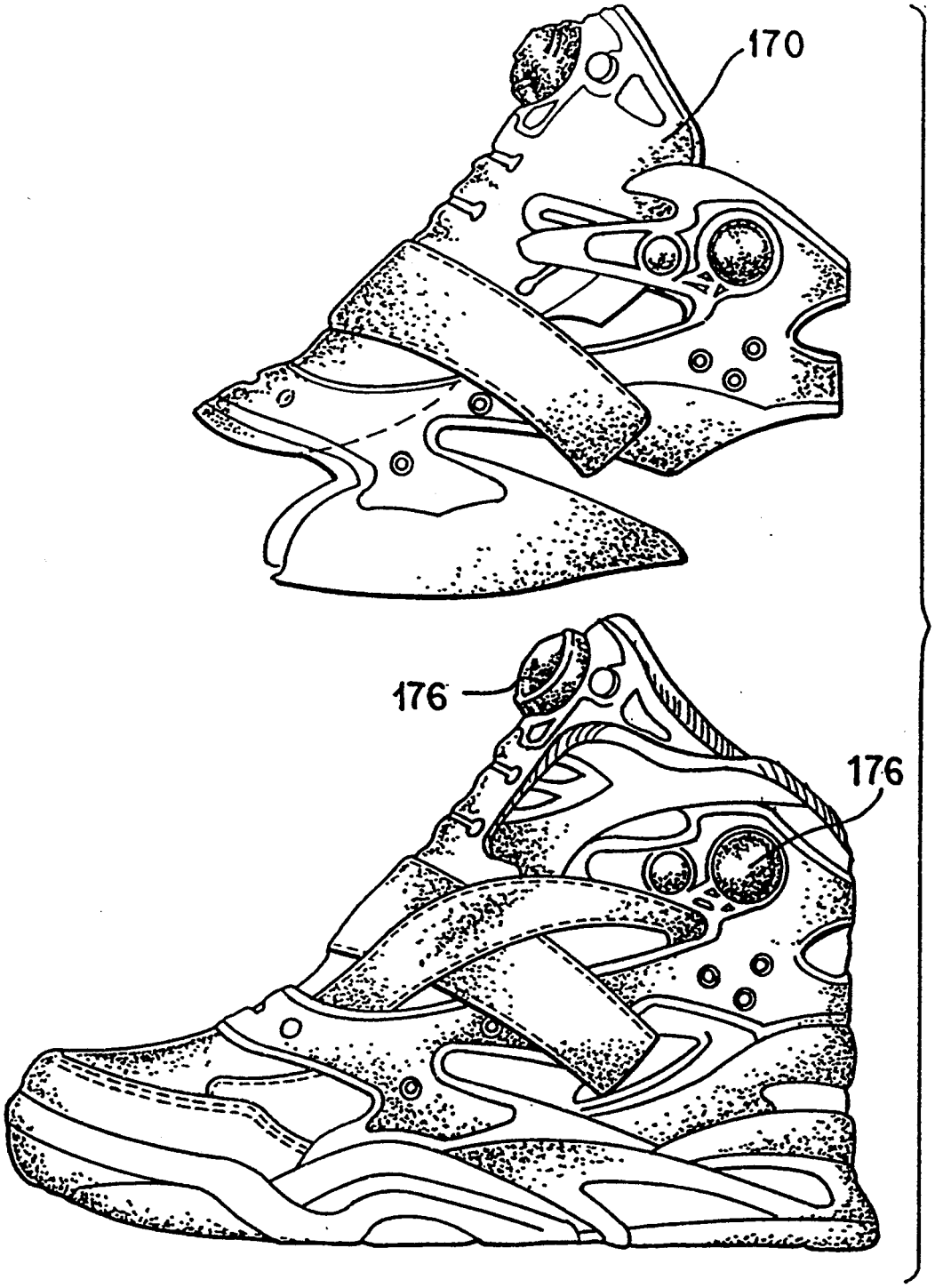
FIG. 16 is an exploded view of an alternate embodiment of the upper of the present invention.
Figure 17:
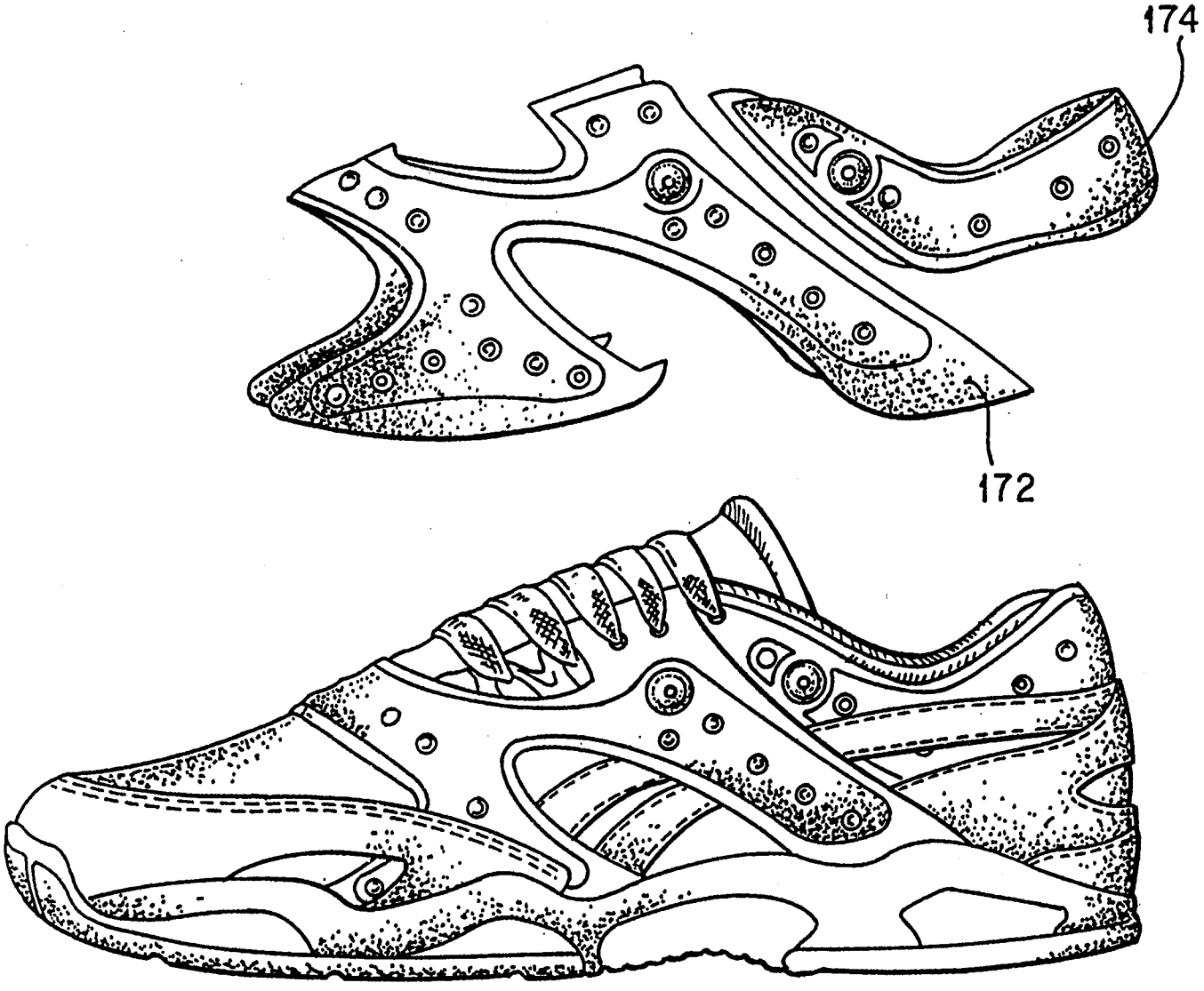
FIG. 17 is an exploded view of an alternate embodiment of the upper of the present invention.

While the present invention has been disclosed in connection with the preferred embodiment thereof, it should be understood that there are other embodiments which fall within the spirit and scope of the invention as defined by the following claims. For example, it is anticipated that individual chamber components may be incorporated into conventional athletic shoes to decrease the total shoe weight. For example, in a typical leather basketball shoe (see FIG. 16), an ankle and tongue chamber component 170 may take the place of a padded ankle collar and tongue to provide lightweight support to the ankle and instep of the wearer. With regard to tennis shoes, quarter and ankle chambers 172 and 174, respectively (FIG. 17) may be stitched to the surrounding leather at the medial and lateral sides to prevent lateral movement of the foot within the shoe. Moreover, as shown in FIG. 16, the inflatable chambers of the upper may be inflated using any conventional on-board inflation mechanism such as a latex bulb 176.

What is claimed is:

1. An athletic shoe, comprising:

a sole;

a first elastic material;

a second elastic material, said first elastic material and said second elastic material being joined to each other along their common peripheral edge to form a substantially fluid impervious chamber; and a foot conforming support member attached to said sole, said fluid impervious chamber being attached to the exterior of said foot conforming support member at selected locations such that at least a portion of said foot conforming support member forms an outermost surface of said upper; and wherein the volume and pressure of the fluid within said fluid impervious chamber remains substantially constant as a force is applied to said sole.

2. The shoe of claim 1, wherein one of said first and second elastic materials comprises a thermal-polyurethane film.

3. The shoe of claim 1, wherein a wicking material is secured to said second elastic material.

4. The shoe of claim 1, wherein said chamber is filled with carbon dioxide ($CO_2$) gas.

5. The shoe of claim 1, further comprising a fluid accepting means.

6. The shoe of claim 5, wherein said fluid accepting means includes a cover which is received by a fluid introducing means.

7. The shoe of claim 6, wherein said fluid introducing means includes a body, a head unit and an adaptor which receives the cover of said fluid accepting means in a fluid-tight manner.

8. The shoe of claim 1, wherein said first and second materials are further joined at points within the periphery of said first and second materials.

9. The shoe of claim 1, wherein said first material and said second material are joined by radio frequency (rf) welding.

10. The shoe of claim 1, wherein said chamber includes several distinct fluid impervious compartments.

11. The shoe of claim 10, wherein each of said compartments is provided with a fluid accepting means.

12. The shoe of claim 1, wherein said foot conforming support member is formed from a stretchable, lightweight fabric.

13. The shoe of claim 1, further comprising an elastic tongue overlay.

14. The shoe of claim 1, further comprising an elastic heel overlay.

15. The shoe of claim 1, wherein said fluid impervious chamber is inflated by an on-board inflation mechanism.

16. The shoe of claim 15, wherein said on-board inflation mechanism is a latex bulb.

17. An upper for an athletic shoe including a sole, comprising:

a first lamina formed of a fluid impervious material and a second lamina attached to said first lamina to form a first laminate, said first laminate being attached to an inner film at selective locations, said first laminate and said inner film forming a substantially fluid impervious chamber wherein said substantially fluid impervious chamber contains a fluid; and a substantially flexible support member which surrounds a substantial portion of a wearer's foot, said fluid impervious chamber being affixed to said flexible support member such that said flexible support member forms at least a portion of the outermost surface of the upper wherein said first laminate forms at least a portion of the outermost surface of the upper;

wherein the volume and pressure of the fluid within said fluid impervious chamber remains substantially constant as a force is applied to said sole of said athletic shoe.

18. The upper of claim 17, wherein said inner film is thermal-polyurethane film.

19. The upper of claim 17, wherein said first laminate is attached to said inner film by radio frequency welding.

20. The upper of claim 17, wherein a wicking material is joined to said inner film.

21. The upper of claim 17, further comprising a fluid accepting means.

22. The upper of claim 21, wherein said fluid accepting means includes a cover which is received by a fluid introducing means.

23. The upper of claim 22, wherein said fluid introducing means includes a body, a head unit and an adaptor which receives the cover of said fluid accepting means.

24. The upper of claim 17, wherein said chamber includes several distinct fluid impervious compartments.

25. The upper of claim 17, wherein said flexible support member is formed from a stretchable, lightweight fabric.

26. The upper of claim 17, further comprising an elastic tongue overlay.

27. The upper of claim 17, further comprising an elastic heel overlay.

28. The upper of claim 17, wherein said fluid impervious chamber is inflated by an on-board inflation mechanism.

29. The upper of claim 28, wherein said on-board inflation mechanism is a latex bulb.

* * * * *